United States Patent [19]

Höckele et al.

[11] 4,169,652

[45] Oct. 2, 1979

[54] METHOD AND APPARATUS FOR CONNECTING ELECTRICAL CONDUCTORS

[75] Inventors: Max Höckele, Berglen-Steinach; Helmut Ruff, Ostfildern, both of Fed. Rep. of Germany

[73] Assignee: Karl Pfisterer Elektrotechnische, Stuttgart, Fed. Rep. of Germany

[21] Appl. No.: 839,585

[22] Filed: Oct. 5, 1977

[30] Foreign Application Priority Data

Apr. 29, 1977 [ZA] South Africa ..... 77/2589

[51] Int. Cl.[2] ..... H01R 11/26

[52] U.S. Cl. ..... 339/246; 339/265 R

[58] Field of Search ..... 339/246, 248, 249, 263, 339/264, 265, 266

[56] References Cited

U.S. PATENT DOCUMENTS

| | | | |
|---|---|---|---|
| 1,979,117 | 10/1934 | Muehleman | 339/265 R |
| 2,287,761 | 6/1942 | Matthysse | 339/265 F |
| 3,012,091 | 12/1961 | Schiffmann | 339/265 R |

FOREIGN PATENT DOCUMENTS

| | | | |
|---|---|---|---|
| 660969 | 6/1938 | Fed. Rep. of Germany | 339/246 |
| 715977 | 1/1942 | Fed. Rep. of Germany | 339/246 |
| 1241512 | 6/1967 | Fed. Rep. of Germany | 339/263 |
| 878518 | 10/1942 | France | 339/246 |
| 67482 | 5/1940 | Poland | 339/246 |

*Primary Examiner*—Joseph H. McGlynn
*Attorney, Agent, or Firm*—Wigman & Cohen

[57] ABSTRACT

This disclosure relates to a method and apparatus for clamping electrical conductors, such as cables. The conductors are placed in clamping channels formed in a clamp body having at least two separate body parts. The channels have a cross-sectional shape deviating from the circular shape of the conductors. When the clamp is pressed together by means of a pressing tool, the body parts bend elastically about the conductors, while the conductor metal deforms to the shape of the clamping channels. The clamp is then secured by at least one screw of required tensile strength sufficient only to absorb the elastic forces of the deformed body parts and conductors.

20 Claims, 10 Drawing Figures

METHOD AND APPARATUS FOR CONNECTING ELECTRICAL CONDUCTORS

BACKGROUND OF THE INVENTION

This invention relates to a clamp for connecting two electrical conductors, particularly in the form of cables, the clamp being particularly suitable for switchgear.

Prior art clamps of the kind including a clamp base portion and at least one clamp cover, a channel between the two parts formed by aligned grooves and a screw for connecting the parts together and thereby connecting two or more conductors have various disadvantages. Even at an amperage of only up to approximately 500 ampere two covers per clamp channel are required for connecting two aluminum cables or steel-aluminum cables, and with higher currents, the number of clamp covers is even larger. The clamps are therefore voluminous, heavy and expensive as regards material and costs. A plurality of clamp covers are required, mainly, because the attainable clamping force, and therewith the compression of the cables, are relatively low, even when screws are used which have a high tensile strength. Not more than a small portion of the current to be transmitted flows across the cover, because screws having a high tensile strength are poor conductors. For the current to be conducted substantially only by way of the bottom part of the clamp is also disadvantageous, insofar as it is desirable, on account of the skin effect that all strands of the outermost layer of the cable are contacted. However, this can be made possible by having the clamp base part of such a length that it can receive a length of cable which is at least half the pitch of the strands. Even when screws of an electrically highly conductive material are used and the conduction of the current by way of the cover would thus be improved, so that an almost uniform current loading of all wires of the outermost layer could be achieved, the clamps could not be of shorter dimensions because the clamping pressure attainable with such screws is relatively low, a fact which could only be compensated by the clamps being suitably lengthened.

A further disadvantage appears with conductors of a large cross-section. While the thermal play in the case of small cross-sections and the flow of aluminum in the case of aluminum cables can still be compensated by means of sets of springs, the clamping force of the screws being transmitted to the clamp body parts by way of these springs this solution cannot be applied to clamps for conductors of a large cross-section.

Also proved to be unsatisfactory were so-called transverse conduction plates, i.e., plates of an electrically highly conductive material, which plates envelop the conductor in the clamping channel like a jacket. These are used for the purpose of limiting the conductive connection between the clamping base part and the conductor, gripped in the clamp, to not only those wires or surface areas which project into the groove of the clamp base part. A substantial improvement of the contact conditions is obtained in this case but only at such clamping forces that cannot be obtained with conventional screws.

Compression screws are free from the aforementioned disadvantages. However, these clamps cannot be used, as a rule, when releasable clamps are required. Moreover, the pressure which must be applied by means of a press is very high, particularly when the clamp is large so that the handling of the press may cause difficulties on account of its size and mass.

SUMMARY AND OBJECTS OF THE INVENTION

A primary object of this invention is to provide a screw clamp which may be used in place of conventional clamps of the aforementioned type, which is lighter and less expensive compared to the former. According to the invention this object is achieved by means of a clamp of the aforementioned type wherein each clamping channel, provided for receiving a cable, has a cross-section deviating from the circular shape of a cable and the outer surface of the clamping body is provided with bearing surfaces for a pressing tool in those regions which approach one another on closing the clamp.

The pressing of the clamp body parts, with the aid of a press onto the conductors to be connected, in place of tightening screw(s), yields the advantage that a contact pressure can be obtained which is by a multiple, larger than the contact pressure which can be achieved by tightening a screw or screws, even when the force of the press is by a multiple smaller than the force which must be applied for mounting a press clamp of a corresponding size. Moreover, this pressure can be selected without difficulty to be so high that in conjunction with the cross-section shape of the clamping channel deviating from the circular form, even a multiple layer cable can be so compressed that the pressure extends to the center of the cable and results in forming contact between all individual strands of the cable, i.e., a maximum conductivity. The high contact pressure as well as the maximum conductivity enables the dimensions of the clamp to be selected substantially smaller than the dimensions of a corresponding clamp wherein the force by which the clamp body parts are pressed onto the strands to be connected is produced only by tightening a screw or screws.

After the clamp is closed with the aid of a pressing tool, the existing screws need only absorb that elastic force of the strands and of the clamp which remains after the pressing procedure and which determines the magnitude of the contact pressure.

This elastic force is substantially smaller than the maximum pressure required, but substantially higher than the elastic force which can be obtained with conventional screw clamps. It is also approximately ten times higher than the resilient force of a compression clamp, i.e., a clamp which is deformed during the pressure procedure. Notwithstanding this very high elastic force and the very high bearing force resulting therefrom, there is no need to use screws made of material of high tensile strength. An electrically-well-conductive material may rather be selected with the result of a good conductive connection between the clamp body parts, which fact in turn, leads to smaller dimensions, lower weight and lower expenditure concerning the clamp according to the invention, as compared with conventional screw clamps.

The radius of curvature of the grooves forming the clamping channel is preferably larger than half the diameter of the cable to be accommodated, as such a clamping channel is particularly suitable as regards the compression attainable and the transverse conductivity of the cables.

In a preferred embodiment the screw or screws holding the clamp body parts together are of the same material as the clamp body parts. This is not only advantageous as regards the prevention of corrosion, but also as regards the maintenance of the bearing force when the temperatures of the conductors and of the clamps change. Maintaining the bearing force is also advantageous if at least one of the two contacting bodies forming a clamping channel is transversely elastic in such a manner that it is elastically deformed when the clamp body parts are pressed onto the conductors with the aid of a press.

If the clamp is not designed so that the bearing surface of one cheek plate of the press, that is the plate that contacts the clamp body during clamping, is provided on the one clamp body part and the bearing surface of the other cheek plate on the other clamp body part, but that both cheek plates engage with the one as well as the other clamp body part, and the bearing surfaces for each press include an acute angle with the plane of division of the clamp body, the force to be produced by the press is reduced on account of the wedge effect. A smaller press which is more easily handled will then suffice.

Another object of the invention is to provide a method through which a substantially higher pressure on conductors to be connected can be achieved than is possible with a conventional screw clamp.

According to the invention this object is achieved by pressing two clamp body parts of a clamp, which form at least one clamping channel, towards each other with the conductor to be connected located in the clamping channel, by means of a pressing tool, without the clamp body parts being permanently deformed, simultaneously deforming the conductor due to mechanical engagement, between it and the clamp body parts; and then securing the clamp body parts together, by screws or the like, while they are maintained in their pressed-together-configuration by the pressing tool. When the conductor is deformed the strands forming it may also be compressed.

To attain a high contact pressure being exerted on stranded conductors, and also a maximum transverse conductivity, the pressure of the press is advantageously increased during the pressing process to a magnitude where the compression of the strands results in a transverse conductivity across its whole cross-section. It is particularly advantageous when the conductor is spread transversely to the direction of the pressure during compression, i.e., ovally.

With the above and other objects in view that may become more apparent hereinafter, the nature of the invention will be more clearly understood by reference to the attached drawings, the following detailed description thereof, and the appended claimed subject matter, wherein:

DETAILED DESCRIPTION OF PREFERRED EMBODIMENTS

Figure 1:
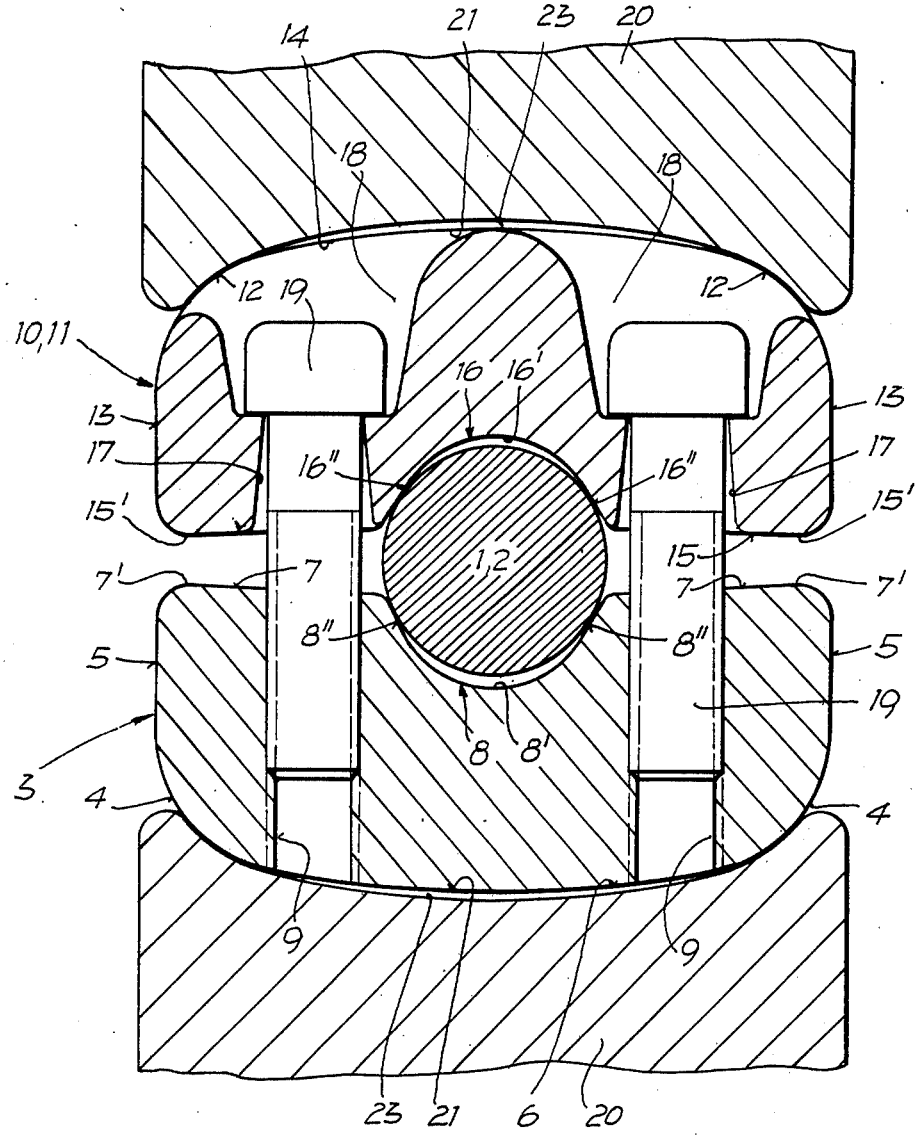
FIG. 1 is a cross-sectional view of a first embodiment of the invention at the start of the closing process; a conductor having been placed into a clamping channel and cheek plates of a pressing tool having been placed thereon.
Figure 2:
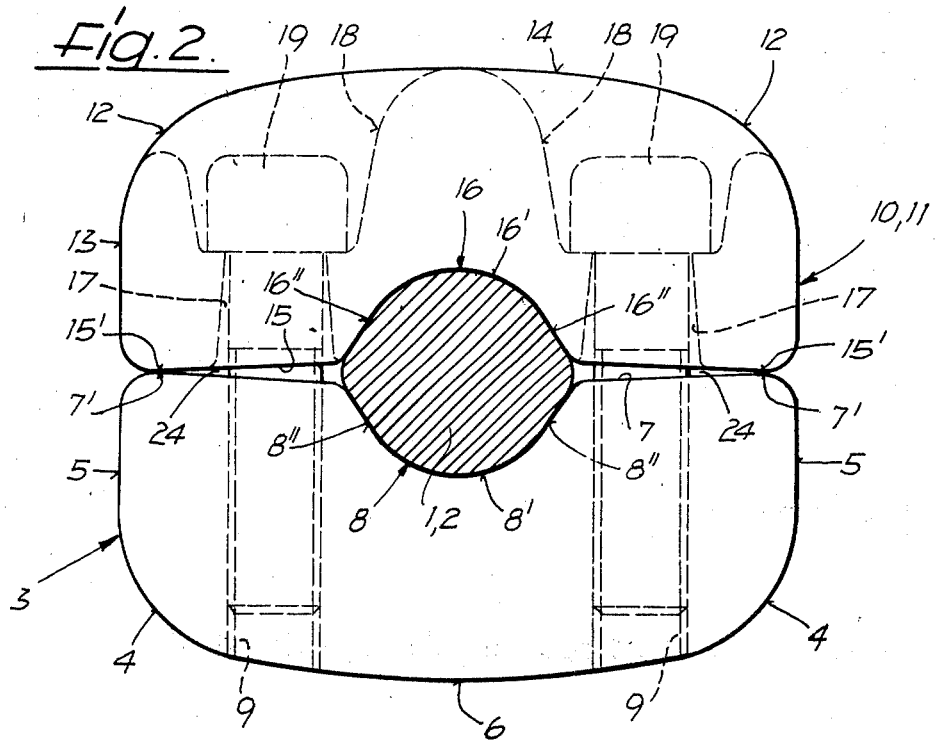
FIG. 2 is a front elevation view of the embodiment according to FIG. 1 in closed state.

Referring now to the drawings in detail, there is illustrated in FIGS. 1 and 2 a high tension switchgear clamp in the form of a connector for connecting two steel-aluminum cables or aluminum cables 1 and 2 coaxially arranged in the region of their opposing ends. The clamp includes an elongated base part 3 made of an aluminum alloy. The cross-section of said base part 3 is substantially rectangular, all edges however, being rounded off as is usual with high tension switchgear clamps in order to avoid corona phenomena. The outer edges 4 are particularly strongly curved. They extend, on the one hand, to the two parallel side faces 5, and on the other hand, to the surface 6 which is only slightly curved, but in the same direction.

An inner surface 7 which is opposite the surface 6 is provided in its center portion with a groove 8 which extends along the whole length of the clamp base part 3 and forms part of the two clamping channels into which the cables 1 and 2 respectively are clamped. As can particularly be seen in FIG. 1, the profile of the cross-section of the grooves 8 comprises, in the groove base, a circular segment 8', the radius of curvature of which is smaller than the desired radius of curvature of the clamping channel, which is equal to half the diameter of the cable to be accommodated. In the region of the two sides of the groove 8, the profile of the cross-section is formed by two straight portions 8" which follow tangentially to the circular segment 8' and include in the exemplary embodiment an angle of approximately 90°.

As FIGS. 1 and 2 show, the inner surface 7 is not planar. Each of the portions disposed at the sides of the groove 8 form with the plane of division extending through the longitudinal axis of the clamping channel an acute angle opening towards the groove.

Tapholes 9 which penetrate through the clamp base part 3 from the inner surface 7, and the longitudinal axis of which is perpendicular to the plane of division, are provided at both sides and at equal distances from the groove 8.

Two identical clamp covers 10 and 11 made of the same aluminum alloy as the clamp base part are associated with the clamp base part 3. The number of these clamp covers is determined by the length of the clamp base 3. If, e.g., two clamp covers would be required in the region of each cable end for transmitting the current between the cables 1 and 2, the clamp base part 3 would have to be accordingly longer.

All the edges of the two clamp covers 10 and 11 are strongly curved in the region of the peripheral areas as those of the clamp base part. As FIGS. 1 and 2 show, the contour of the cross-sectional area is identical with the contour of the cross-sectional area of the clamp base part. The curvatures 12 which replace the two outer longitudinal edges and form the transition from the two parallel side faces 13 to the surface 14, which is slightly curved in the same manner as the surface 6, have therefore the same radius of curvature as the curvatures 4. A groove 16 which is aligned with the groove 8 and extends along the whole length of the cover has the same cross-sectional profile as groove 8. Groove 16 of cover 10, together with groove 8 forms the clamp channel for the cable 1, while the groove in cover 11 together with groove 8 forms the clamp channel for the cable 2. The circular segment which forms the base of groove 16 and the radius of which is smaller than the radius of the cable to be received, is marked 16'. It is followed tangentially by the two straight portions 16''. The angle between the surface portions of the inner surface at both sides of the groove 16, and the plane of division has the same magnitude as the corresponding angle between the plane of division and the inner surface 7 of the clamp base part 3.

Both covers 10 and 11 are provided with two through bores 17 which are spaced from the groove 16 and are aligned with the two associated tapholes 9 in the clamp base part 3. The through bores 17 widen conically towards the inner surface 15 to form an oblong hole.

Apart from the substantially smaller length, the clamp covers 10 and 11 differ from the clamp base part 3 particularly in that they are elastically deformable in a transverse direction which renders them inherently resilient. This transverse elasticity is obtained by selecting a suitable cross-section and suitable dimensions. As shown in FIG. 1, the thickness of the clamp cover is substantially reduced in the two side regions where the through bores 17 are disposed. The recesses 18 which are provided in these side regions are open towards the surface 14, permitting the heads of screws 19 to be accommodated therein, by which screws the covers 10 and 11 and the clamp base part 3 can be releasably joined. The shanks of these screws 19 have a larger diameter than the screws used for conventional switchgear clamps of the same size, as the starting torque must be taken into account. These screws are of light metal, e.g., of an aluminum alloy. On the one hand, the clamp covers 10 and 11 are connected with the clamp base part 3 in an electrically good conductive manner, and on the other hand, contact corrosion can be avoided. The length of the screws 19 is such (as shown in FIG. 2) that they do not project from the tapholes 9 when the clamp is closed to ensure against the formation of a corona.

The transverse elasticity need not be restricted to the clamp covers. The clamp base part may be transversely elastic alone or in addition.

Because the closing of the clamp is not effected by tightening the screws 19, but with the aid of two cheek plates 20 of a pressing tool, these cheek plates being movable towards each other, the clamp base part 3 and the clamp covers 10 and 11 are each provided on their surface with a bearing surface for the cheek plates 20. These bearing surfaces are formed in the case of this embodiment by the two areas which are formed by the curvatures 4 or 12, respectively. These regions are thus disposed symmetrically on both sides and spaced from the center plane which is perpendicular to the plane of division and contains the longitudinal axis of the clamp channel. As shown in FIG. 1, the two cheek plates 20 rest initially only against the areas of these bearing surfaces. Only after an elastic transverse deformation to a predetermined magnitude has taken place, do they also contact an additional bearing surface 21 which is disposed between the areas formed by the curvatures.

Because the cheek plates 20 of this embodiment do not have a shape which would determine the obtainable final position, they are moved towards one another by increasing the pressure, until the stop faces formed by the lateral edge zones 7' and 15' of the inner surfaces 7 and 15 respectively abut against each other. The cable end embraced is thereby highly compressed and at the same time so deformed that it adjusts itself completely to the cross-sectional shape of the grooves 8 and 16, as shown in FIG. 2. During this deformation, the sides of the grooves scrape over the surface of the cable and thus assist in removing an existing oxide layer.

When the cover engages in the region of its stop faces, the bearing faces of the clamp base section, the screws 19 are screwed through openings in the cheek plates 20 into the tapholes 9 until their heads engage the associated bearing surfaces of the clamp cover. The screws are accordingly not tightened. When the press plates 20 are subsequently removed, the screws 19 hold the cover and base part together. They maintain substantially the elastic transverse deformation which is determined by the size of a gap 23 which is eliminated during the pressing process only when the desired transverse deformation has been attained and the pressure is then increased so that the cable is further compressed.

According to FIG. 2, a gap 24 which widens towards the clamp channel remains between the inner surfaces 7 and 15 at both sides of the clamp channel in the closed position of the clamp. The clamp cover and the clamp base part may thus resiliently follow if there is a reduction of the cross-section of the cable embraced, i.e., as a result of cooling or flow of the conductor material.

Figure 3:
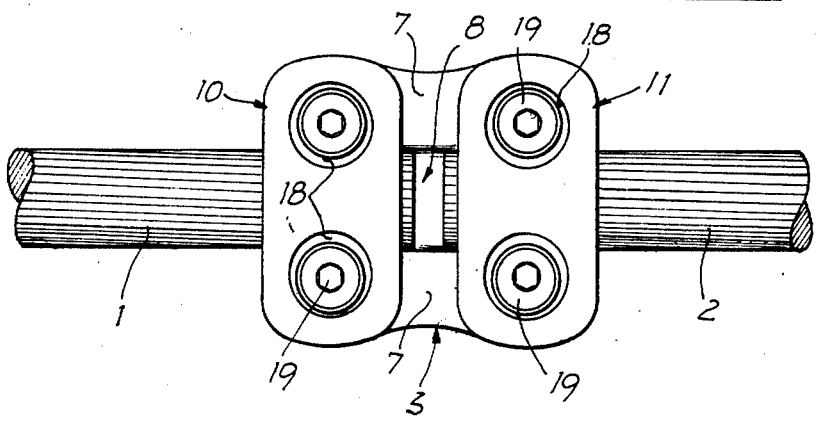
FIG. 3 is a top plan view of the first embodiment.
Figure 4:
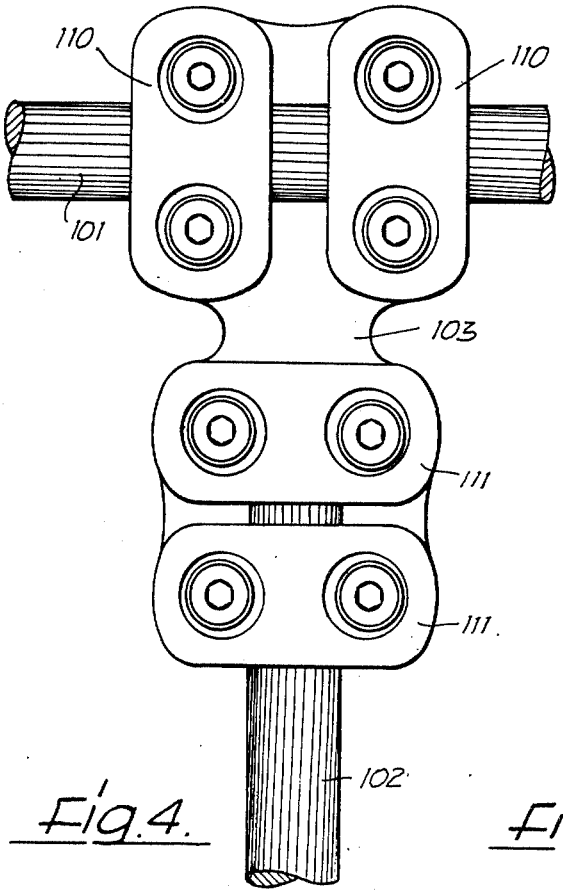
FIG. 4 is a top plan view of a second embodiment in the form of a T-branch terminal.
Figure 5:
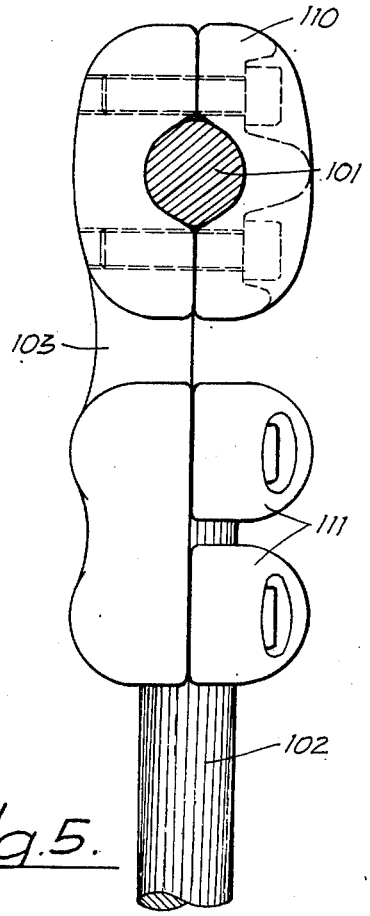
FIG. 5 is a side elevation view of the second embodiment.

FIGS. 4 and 5 show a high tension switchgear clamp in the form of a T-branch terminal. The T-shaped clamp base part 103 is in this case associated with two identical clamp covers 110 for embracing the main conductor 101 and two clamp covers 111 for embracing the branch conductors 102. The clamp covers 110 and 111 are designed like the clamp covers 10 and 11 of the embodiment according to FIGS. 1 and 3, and the cross-section of the clamp base part 103 has in the regions supporting the clamp covers the same shape as the cross-section of the clamp base part 3 of the first embodiment. As regards the design of the clamp base part and of the clamp covers and of the method of closing the clamp and the properties thereof, reference is therefore made to the embodiment according to FIGS. 1 and 3.

Figure 6:
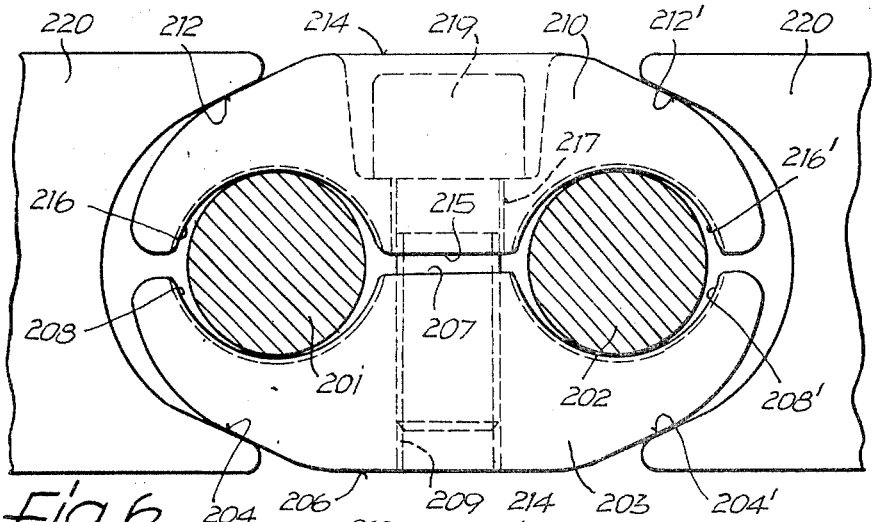
FIG. 6 is a front elevation view of a third embodiment at the start of the closing process, conductors having been placed into the clamping channels and the cheek plates of a pressing tool having been placed thereon.
Figure 7:
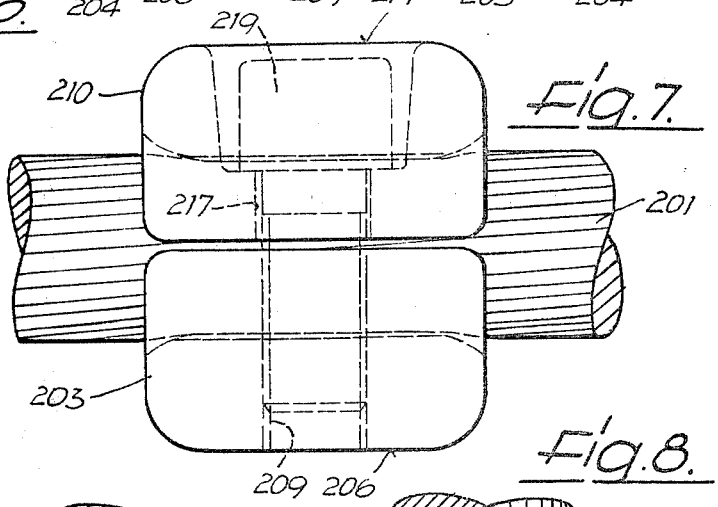
FIG. 7 is a side elevation view of the third embodiment.

The third embodiment illustrated in FIGS. 6 and 7 is, as in the aforedescribed embodiments, a clamp for high tension installations; however, it is designed as a branch clamp. The clamp body made of an aluminum alloy comprises a clamp base part 203 and a clamp top part 210, the external shape of which is substantially the same. The rectangular inner surface 207 of the clamp base part 203, which inner surface faces the clamp top part, is provided with grooves 208 and 208', respectively, in its two side zones. These two grooves are parallel and extend (as shown in FIG. 7) from one front face of the clamp body to the other. The grooves 208 and 208' are aligned with two identical grooves 216 and 216' in the inner surface 215 of the clamp top part 210 which faces the clamp base part, said grooves together forming two clamp channels for two conductors 201 and 202 which are in this embodiment two aluminum cables or steel-alumimum cables. The radius of curvature of the cross-sectional area of the grooves 208, 208', 216 and 216' is approximately 20% larger than the desired radius of the two conductors 201 and 202. Peripheral cutting edges on the grooves permit that an oxide layer which could possibly exist on the periphery of the conductors to be received, can be pierced, thereby improving contact. As shown in FIG. 7, the two clamp channels formed by the grooves widen outwardly in their two end portions so that the clamping effect exerted on the conductor is reduced in order to avoid damages as a result of oscillations.

A taphole 209 which is perpendicular to the inner surface 207 and the diameter of which is only slightly smaller than the gap between the two clamp channels, penetrates centrally the center portion of the clamp base part 203. A through bore 217 in the clamp top part 210 is aligned with this taphole 209; the through bore has a wider portion extending from the center portion of the surface 214, which center portion extends parallel to the inner surface 215. The axial length of this wider portion is slightly longer than the axial length of the head of screw 219 made of the same aluminum alloy as the clamp base part and the clamp top part. The shaft of this screw penetrates into the taphole 209 and the head thereof abuts against an annular shoulder of the through bore 217, this annular shoulder being formed at the transition of the wider portion to the portion having a smaller diameter.

The thickness of the clamp base part 203 and of the clamp top part 210 in the center portion which is penetrated by the taphole 209 and the through bore 217, respectively, is approximately double the radius of the curvature of the grooves. The thickness decreases outwardly in the two side portions where the grooves are provided (as shown in FIG. 6). This is caused in that a first portion of the side zones which follows the center portion includes an acute angle with the inner surface 207 or 215, respectively, or with the plane of division of the clamp body, this angle being 25° in the embodiment, and that this first portion is followed by a curved, second portion in which this angle constantly increases towards the outer edge. Because this shape of the surface is the same in both clamp body parts, the surfaces 206 and 214 are symmetrical, relative to the plane of division of the clamp body.

The first portions of the surfaces 206 and 214 and disposed in the region of the two clamp channels, for bearing surfaces 204 and 204', or 212 and 212', respectively, for two cheek plates 220 of a pressing tool, the cheek plates being removable against each other in a straight line. The one cheek plate 220 is placed on the bearing surface 204 and 212 (as shown in FIG. 6) and the other on the bearing surfaces 204' and 212', so that the cheek plates may slide over the bearing surfaces while they are moved together. The shape of their contact faces is adapted to the shape of the bearing surfaces of the clamp body.

All edges of the clamp base part 203 and of the clamp top part 210 are substantially rounded off in order to prevent corona discharges.

The clamp is mounted in the following manner: The clamp base part 203 and the clamp top part 210 are placed on the two conductors 201 and 202 as shown in FIG. 6 and are held in this position by the pre-mounted screw 219 which is easily accessible even after the cheek plates have been placed into position. The cheek plates 220 are then placed onto the bearing surfaces 204 and 212, and 204' and 212', respectively, after the latter have been greased, if desired, so that they may slide more easily over the bearing surfaces. The cheek plates 220 are then moved together. As a result of the inclined position of the bearing surfaces, relative to the plane of division of the clamp body, the clamp base part and the clamp top part are moved towards each other and are pressed onto the conductors. The magnitude of this force depends, apart from the pressure of the press, also on the angle of the bearing surfaces. In the embodiment described, the selected angle of 25° increases the effect. Even with a relatively low pressure by the press of a few tons, the clamp base part 203 and the clamp top part 210 may be brought so close together that the two cables within the clamp channels are compressed right to the core. The cables expand thereby in width in the region of the clamp channels, because the radius of curvature of the grooves is larger than the radius of the cables, as has been mentioned before. By pressing the cables into an oval, the compression, the contact formation, and the transverse conductivity between the individual wires are improved. When the press has attained the desired maximum pressure, the screw 219 is screwed into the taphole 209 until its head abuts against the shoulder of the through bore 217. The pressure by the press may then be completely relieved and the cheek plates 220 may be removed. The screw 219 absorbs now the total elastic force and maintains thereby a very high bearing force, even when thermal expansions occur, because the coefficient of thermal expansion of the screw is the same as that of the clamp body.

Such a branch clamp may be used in various ways. As shown in FIG. 9, a T-branch on a twin cable conductor can be produced with three branch clamps according to FIGS. 6 to 8. A branch conductor cable 226, may be connected with a conductor 227 of the twin cable by way of a first clamp 225. One end of a connecting cable 228 is connected to the other cable 229 of the twin cables by means of a second clamp 225' which is slightly displaced relative to clamp 225 in the direction of the conductor, and the other end is connected to the branch conductor cable 226 by means of a third clamp 230.

A T-branch may be produced analogously on a single conductor. The two clamps 225 and 225' could be placed on the same conductor with a suitable spacing.

Figure 10:
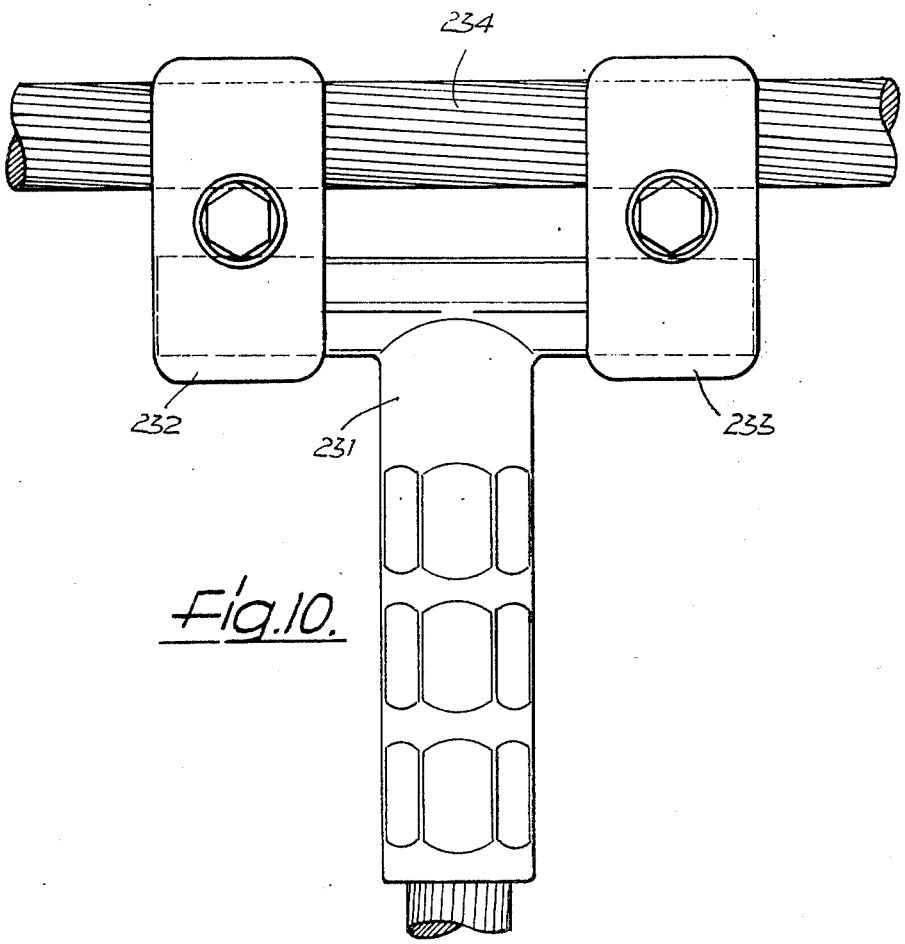
FIG. 10 is an elevation view of a T-branch produced with two clamps according to the third embodiment.

FIG. 10 shows a T-branch made with the aid of a T-shaped connector 231. Each of the two massive crossarms of the connector 231 are here also connected to a main conductor 234 by means of clamps 232 and 233 which are designed like the clamp illustrated in FIGS. 6 to 8. The massive crossarms can thus be deformed as desired when the main conductor in the form of a cable is compressed on closing the clamp. It is advisable that the shape of the cross-section of the crossarms deviates from the circular shape and is, for example, octagonal.

Figure 8:
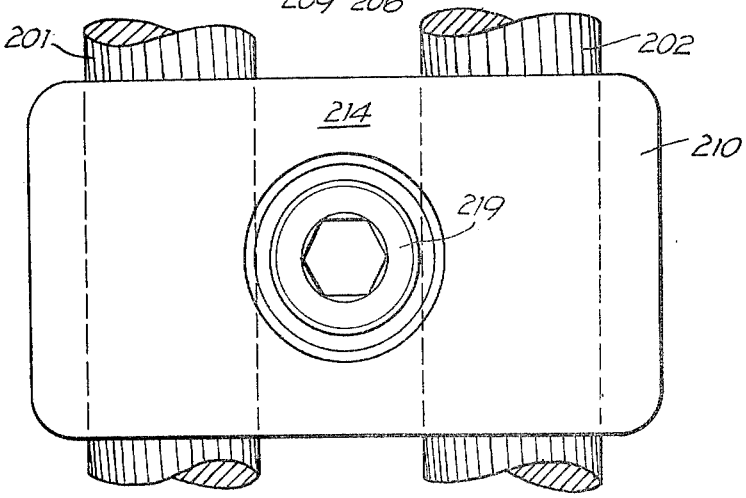
FIG. 8 is a top plan view of the third embodiment.
Figure 9:
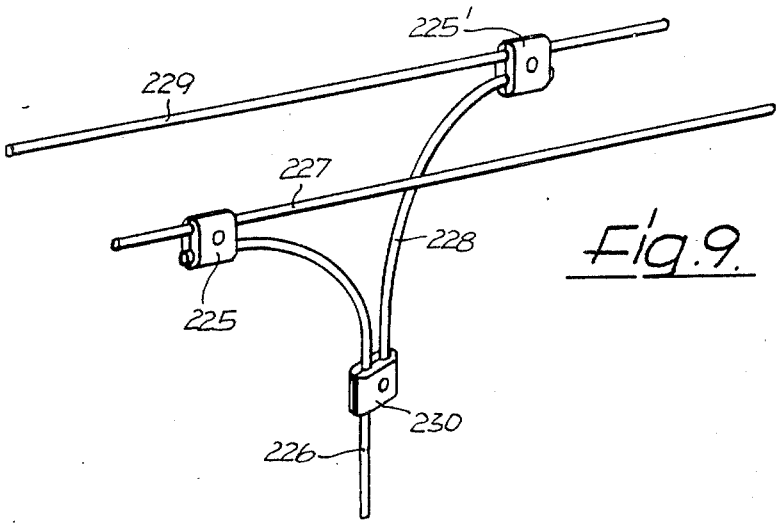
FIG. 9 is perspective view of a T-branch having three clamps and produced according to the third embodiment, for a twin cable conductor.

The use of the clamp according to FIGS. 6 to 8 is, however, not limited to the aforementioned modes of application. This clamp may also be used, e.g., as a connecting clamp for circuit loops at that end of the conductor which is gripped by an anchor clamp or as a clamp for multi-cable systems.

Although only preferred embodiments of the invention have been specifically illustrated and described herein, it is to be understood that minor modifications could be made therein without departing from the spirit and scope of the invention as defined in the appended claims.

We claim:

1. A clamp for connecting two electrical conductors of circular cross-sectional shape such as cables for switchgear, or the like, comprising a clamp body having at least two parts of highly electrically conductive material such as aluminum alloys, at least one of the two clamp body parts being transversely elastic, at least one channel formed by aligned grooves in the two clamp body parts for clamping the conductors, at least one screw for connecting the two clamp body parts, said at least one clamping channel having a cross-section deviating from the circular shape of the conductors, the outer surface of the clamp body having bearing surfaces for receiving a pressing tool means for pressing said two clamp body parts together and for elastically deforming said at least one transversely elastic clamp body part and said conductors, and wherein said at least one screw holding the two clamp body parts together is of the same material as the two clamp body parts.

2. A clamp according to claim 1, wherein said at least one channel is circular in cross-section the radius of curvature of which is larger than half the diameter of the conductors received therein.

3. A clamp according to claim 2, wherein the radius of curvature of the at least one channel is approximately 1 to 2 times larger than half the diameter of the cable received therein.

4. A clamp according to claim 1, wherein said bearing surfaces are arranged on the side portions of the clamp body parts about both sides of a center portion.

5. A clamp according to claim 4, wherein said clamp body includes two body parts defining two clamping channels which are spaced apart and extend parallel to one another, said body parts having bearing surfaces which include an acute angle with the plane of division of the clamp body when the body parts are connected in the region between the clamping channels by at least one screw.

6. A clamp according to claim 4, further including an additional bearing surface provided in the center portion of the clamp body parts when the clamp channel is arranged in the center portion, and bores for two of said screws are provided in the two side portions.

7. A clamp according to claim 6, wherein the two clamp body parts forming the clamping channel have bearing surfaces only along the two outer edge zones of the inner surfaces facing one another, which edge zones extend in a longitudinal direction of the clamping channel.

8. A method of producing a connection between at least two conductors with a clamp including at least two body parts which define between them at least one clamping channel, comprising:

pressing the clamp body parts towards one another by means of a pressing tool, without permanently deforming the clamp body parts;

simultaneously compressing the conductors between these clamp body parts when they are pressed together; and securing the clamp body parts together while maintaining them in their pressed together configuration.

9. A method as claimed in claim 8, wherein the conductors are deformed when the clamp body parts are pressed together.

10. A method according to claim 8, wherein the pressure of the press is increased during the pressing process to a magnitude which results in a compression leading to transverse conductivity between the clamp body parts and the conductor across the whole cross-section of the latter.

11. A method according to claim 8, wherein the conductor expands transversely to the direction of the pressure when it is compressed.

12. A method according to claim 8, wherein at least one of the clamp body parts is elastically deformed during the pressing process.

13. A method according to claim 8, wherein the clamp body parts are secured together by means of at least one screw which is tightened after attaining the maximum pressure only until the start of a tensile load on the screw due to such tightening.

14. A clamp for connecting two conductors of circular cross-sectional shape such as cables for switchgear or the like, comprising a clamp body having at least two parts, at least one of said parts being transversely elastic, at least one channel formed by aligned grooves in the clamp body parts for clamping the conductors, said at least one channel having a cross-section deviating from the circular shape of the conductors, the outer surface of the clamp body having bearing surfaces for receiving a pressing tool means for pressing said body parts together and for elastically deforming said at least one transversely elastic body part and said conductors, at least one screw for connecting the clamp body parts while in said pressed-together condition, said at least one screw being of the same material as the clamp body parts, and wherein said at least one screw has a tensile strength substantially no greater than that necessary to maintain said clamp body parts in pressed-together condition while absorbing the combined elastic forces of said at least one elastically deformed clamp and conductors.

15. A clamp according to claim 14, wherein said at least one channel is circular in cross-section the radius of curvature of which is larger than half the diameter of the conductors received therein.

16. A clamp according to claim 15, wherein the radius of curvature of the at least one channel is approximately 1 to 2 times larger than half the diameter of the cable received therein.

17. A clamp according to claim 14, wherein said bearing surfaces are arranged on the side portions of the clamp body parts about both sides of a center portion.

18. A clamp according to claim 17, wherein said clamp body includes two body parts defining two clamping channels which are spaced apart and extend parallel to one another, said body parts having bearing surfaces which include an acute angle with the plane of division of the clamp body when the body parts are connected in the region between the clamping channels by at least one screw.

19. A clamp according to claim 17, further including an additional bearing surface provided in the center portion of the clamp body parts when the clamp channel is arranged in the center portion, and bores for two of said screws are provided in the two side portions.

20. A clamp according to claim 19, wherein the two clamp body parts forming the clamping channel have bearing surfaces only along the two outer edge zones of the inner surfaces facing one another, which edge zones extend in a longitudinal direction of the clamping channel.

* * * * *